United States Patent [19]

Malchow

[11] Patent Number: 4,503,584

[45] Date of Patent: Mar. 12, 1985

[54] ENCLOSURE STRUCTURE WITH DOUBLE-ACTING HINGE MECHANISM HAVING INTERLOCKING PIVOTAL LATCH

[75] Inventor: Gregory L. Malchow, Lincoln Township, Berrien County, Mich.

[73] Assignee: Whirlpool Corporation, Benton Harbor, Mich.

[21] Appl. No.: 427,112

[22] Filed: Sep. 29, 1982

[51] Int. Cl.[3] ..... E05D 15/50

[52] U.S. Cl. ..... 16/232; 16/366; 16/380; 16/DIG. 23; 292/336

[58] Field of Search ..... 16/230, 231, 232, 233, 16/257, 258, 259, 260, 263, 267, 268, 269, 270, 321, 323, 324, 325, 326, 327, 333, 335, 343, 345, 346, 347, 348, 349, 352, 357, 360, 366, 380, DIG. 32, DIG. 23; 49/382, 193; 292/336; 312/138, 214, 215, 222

[56] References Cited

U.S. PATENT DOCUMENTS

| | | | |
|---|---|---|---|
| 321,266 | 6/1885 | Whitney . | |
| 418,255 | 12/1889 | Welter . | |
| 2,660,752 | 12/1953 | Carcereny | 16/230 |
| 2,711,803 | 6/1955 | Hurst . | |
| 2,886,375 | 5/1959 | Crawford . | |
| 3,020,084 | 2/1962 | Sylvester . | |
| 3,290,719 | 12/1966 | Courson . | |
| 3,889,419 | 6/1975 | Maleck . | |
| 4,222,149 | 9/1980 | Holbek . | |

FOREIGN PATENT DOCUMENTS

| | | | |
|---|---|---|---|
| 100160 | 10/1964 | Denmark . | |
| 2255750 | 5/1974 | Fed. Rep. of Germany | 292/216 |

*Primary Examiner*—Fred A. Silverberg

*Attorney, Agent, or Firm*—Wood, Dalton, Phillips Mason & Rowe

[57] ABSTRACT

Mounting structure for mounting a door to a cabinet for selectively closing an access opening. The mounting structure permits the door to be swung open outwardly from either of the sides of the opening. The mounting structure includes latch members which are retained in the opened disposition by a spring-biased interlock and which are urged toward a hinge-engaging disposition by a biasing spring and connecting rod upon disengagement of the interlock. In the illustrated embodiment, the interlock is mounted to the latch structure.

3 Claims, 4 Drawing Figures

FIG. 1
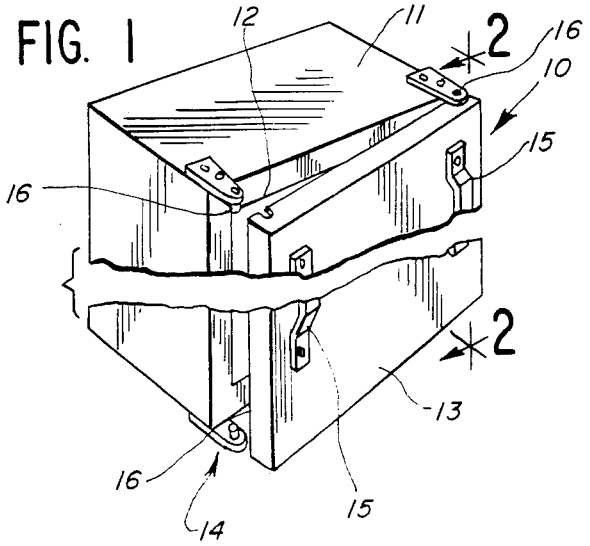
FIG. 2
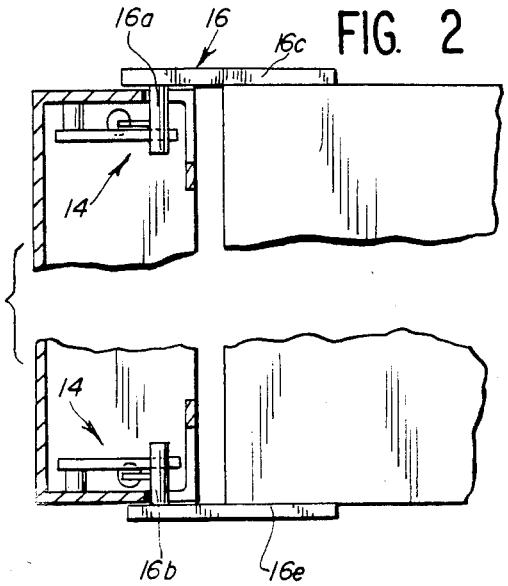
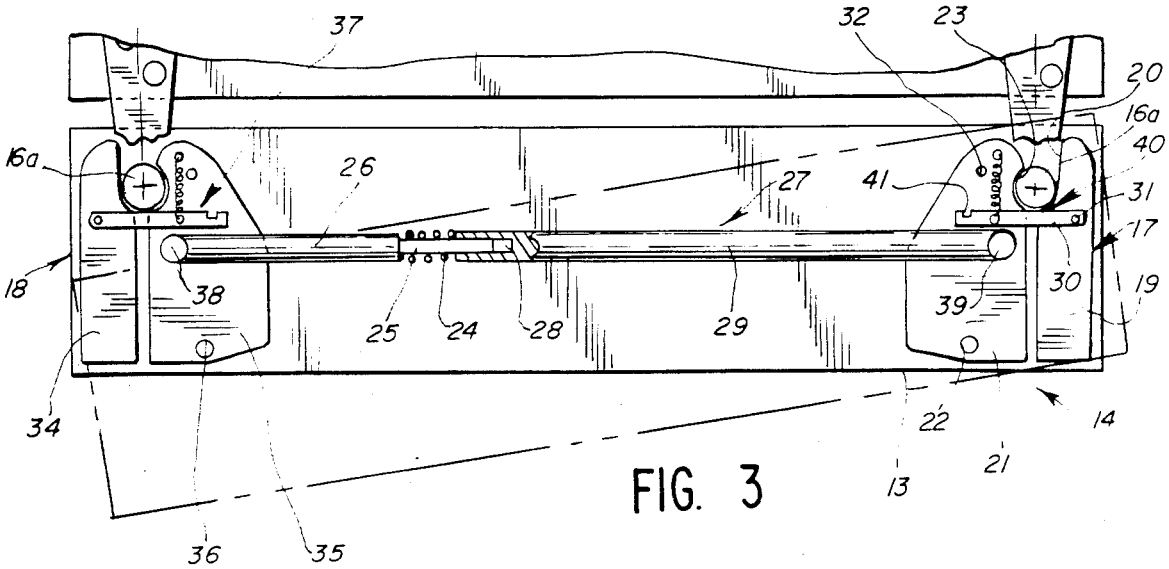
FIG. 3
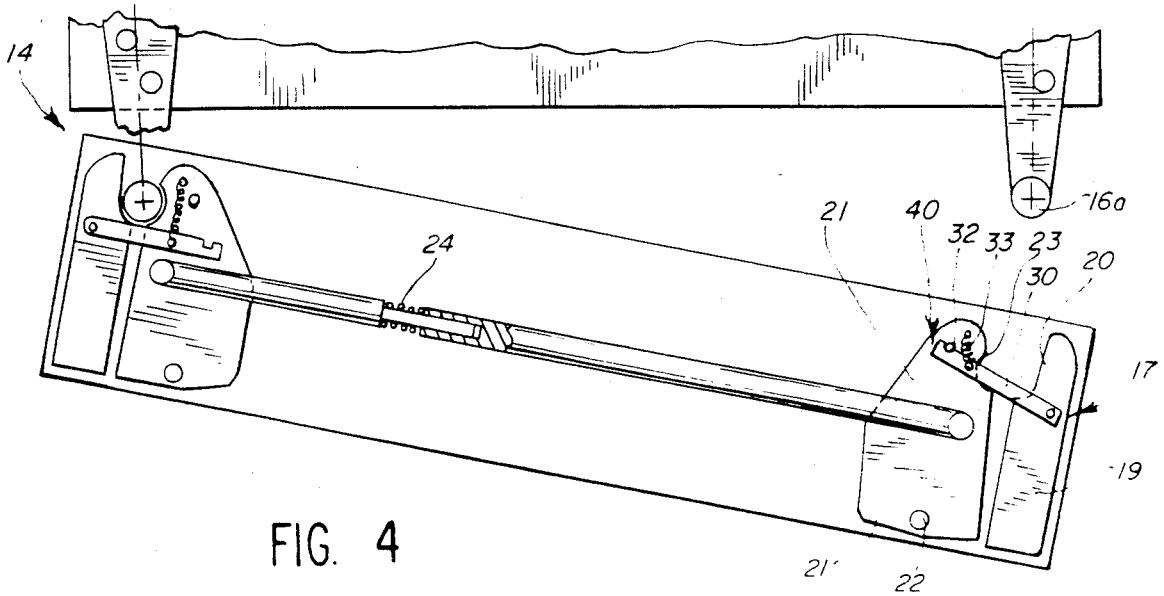
FIG. 4

ENCLOSURE STRUCTURE WITH DOUBLE-ACTING HINGE MECHANISM HAVING INTERLOCKING PIVOTAL LATCH

BACKGROUND OF THE INVENTION

1. Field of the Invention

This invention relates to enclosure structures and in particular to mechanism for mounting a door to a cabinet to be selectively openable from either side of an access opening selectively closed by the door.

2. Description of the Prior Art

In refrigerators and the like, it is desirable to provide the access doors thereof to open from either the left or right-hand side of the cabinet. One example of such a refrigerator enclosure structure is illustrated in U.S. Pat. No. 3,889,419 of Leroy Maleck. As shown therein, the cabinet is provided with a hinge pin disposed in each corner of the access opening and the door is provided with a pair of bolt assemblies, each having a bolt member which is slidable into entrapping engagement with the hinge pin for the purpose of forming a hinge mounting adjacent either the left or right-hand side of the door. The door includes a pair of handles on the right and left-hand sides thereof. Each handle engages the bolt assemblies to shift the bolts to form the hinge assembly on the side opposite to the handle that is being actuated.

In U.S. Pat. No. 3,290,719, Iber C. Courson discloses a reversibly openable door provided with a double-acting hinge construction which does not require manipulation of the latching apparatus as a separate operation prior to opening of the door. The door mounting structure includes a plurality of slidable links which are articulated and provide tracks for providing the desired reversible opening function.

P. W. Sylvester discloses, in U.S. Pat. No. 3,020,084, a two-way truck tailgate mechanism which incorporates a pair of manually actuated movable jaw members which cooperate to engage and retain a pivotally movable portion of the tailgate assembly.

SUMMARY OF THE INVENTION

The present invention comprehends an improved mounting means for mounting a door to a cabinet for releasably retaining the door in a closed position across the opening and permitting the door to be swung open outwardly from either of the sides of the opening to an open position. It is a primary object of the invention to provide such a door mounting means which provides positive latching of the door in the closed position but requires only a small force by the operator to effect either opening or latched closing movement of the door.

The invention comprehends the provision of such an improved mounting means including a first hinge pin fixed to the cabinet at one side of the opening, a second hinge pin fixed to the cabinet at the opposite side of the opening, a first latch on the door releasably embracing the first hinge pin to define a first pivotal connection of the door to the cabinet, a second latch on the door releasably embracing the second hinge pin to define a second pivotal connection of the door to the cabinet, a resiliently extensible connecting rod connected between the latches and having a minimum length preselected to prevent opening of the other latch whenever either one of the latches is opened as by pivotally swinging the door away from the cabinet about the hinge pin embraced by the other latch, and interlock means for maintaining the connecting rod in the minimum contracted disposition as an incident of movement of either latch to the open disposition.

In the illustrated embodiment, the connecting rod includes a pair of rigid rod portions disposed in end-to-end arrangement, with resilient means biasing the rod portions apart and with cooperating stop means on the rod portions for limiting movement of the rods toward each other.

The interlock means, in the illustrated embodiment, comprises interlocking elements on the latches for retaining the latches in the open disposition.

More specifically, the disclosed interlock means comprises a first interlock member on the door and a second interlock member on the latch, and means biasing the interlock member into engagement as an incident of movement of the latch to the open disposition. The latch may include a first latch portion fixedly mounted on the door and, in the illustrated embodiment, the first interlock element is movably carried on the fixed latch member.

The interlock means, in the illustrated embodiment, includes a first interlock member pivotally mounted to the door and having a notch for receiving in a second interlock member carried on the movable portion of the latch to be received in the notch in the interlocking disposition. A spring is provided for urging the interlock means to the interlocking disposition when the latch is arranged in the open disposition.

In broad aspect, the invention utilizes an interlock means which may be readily disposed in the released and interlocking dispositions so that closing movement of the door requires only that the hinge pin provide a slight repositioning of the interlock means, permitting the biasing means of the connecting rod to effect the movement of the latch to the hinge pin embracing disposition. Resultingly, the door may be closed with a minimum of force while yet a positive locked association of the latch with the hinge pin is effected, and at the same time permitting the desirable opening of the door from either side of the access opening. In addition, only a small force is necessary to open the door from either side.

The improved mounting structure of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 is a fragmentary perspective view of an enclosure structure having improved door mounting means embodying the invention;

FIG. 2 is a fragmentary enlarged vertical section taken substantially along the line 2—2 of FIG. 1;

FIG. 3 is a fragmentary horizontal section illustrating the arrangement of the door mounting means in greater detail; and FIG. 4 is a horizontal section generally similar to that of FIG. 3, but illustrating the arrangement of the mounting means with the door in an open position.

DESCRIPTION OF THE PREFERRED EMBODIMENT

In the illustrative embodiment of the invention as disclosed in the drawing, an enclosure structure generally designated 10 is shown to comprise a cabinet 11 having an access opening 12 selectively closed by a door 13. The door is mounted to the cabinet by an improved mounting means generally designated 14, permitting the door to be swung open outwardly from either of the opposite sides of the access opening, as desired. The door may be provided with a pair of fixed handles 15 for effecting such selective opening.

As seen in FIG. 1, mounting means 14 includes a plurality of hinge pins 16 mounted to the cabinet including a pair of upper, downwardly extending pins **16*a* and a pair of upwardly extending pins 16*b* mounted to the cabinet by suitable mounting plates 16*c*. The mounting means comprises similar mechanism at the top and bottom of the cabinet, as illustrated in FIG. 2**. The description hereafter of the mounting means is limited to the upper mechanism, it being understood that the description applies equally to the lower mechanism, with the parts thereof being upside down relative to the top mechanism.

The construction of each of the mounting mechanisms 14 is illustrated in greater detail in FIGS. 3 and 4. As shown in FIG. 3, mechanism 14 includes a first latch structure 17 for cooperation with the right-hand hinge pin **16*a*, and a second latch structure 18 for cooperation with the left-hand hinge pin 16*a*'. Each latch structure includes a first latch member 19 fixedly secured to the door 13 and defining a recess 20** for receiving a portion of the hinge pin when the door is in the closed disposition.

Each latch structure further includes a second latch member 21 which is pivotally mounted to the door by a pivot pin 22 and which includes a recess 23 for embracing the latch pin when the door is in the closed disposition, as illustrated in FIG. 3.

Latch member 21 is biased toward its closed disposition, as illustrated in FIG. 3, by a coil spring 24 mounted about a pin projection 25 on a first connecting rod portion 26 of a latch connecting rod generally designated 27. The pin projection is received in a recess 28 of a second rod portion 29 of the connecting rod 27, which extends in end-to-end, aligned relationship to rod portion 26. Thus, spring 25 urges rod portion 29 to the right, as seen in FIG. 3, biasing the movable latch member 21 in a clockwise direction whereby the notch 23 is disposed to receive the pin **16*a*** in the latched disposition of the mechanism.

When the door is swung to an open position wherein the latch 17 is moved away from hinge pin **16*a*, as seen in FIG. 4, the outward movement of the door causes pin 16*a* to cam the latch member 21 in a counterclockwise direction against the biasing action of spring 24. At the same time, an interlock structure generally designated 40 is activated so as to cause a notched portion 41 of an interlock element 30, which is pivotally mounted to the latch member 19 by a pivot pin 31, to receive an interlock pin element 32 mounted on the latch member 21. Interlock element 30 is resiliently biased to the interlocked position as by spring 33 connected between the element 30 and latch member 21 for effecting biased pivotal movement of the interlock element about pivot 31**.

When the door is moved to the closed position of FIG. 3, hinge pin **16*a* bears against interlock element 30 to disengage the notch 41 from pin 32, thereby releasing hinge member 21 for clockwise rotation by spring 25 in effecting the desired latching of the door to hinge pin 16*a***.

The left-hand latch 18 is reversely identical to right-hand latch 17. Thus, latch 18 includes a first latch member 34 fixed to the door and a second latch member 35 pivotally mounted to the door by a pin 36. The pivotal latch member 35 is retained in the opened position by an interlock 37 similar to interlock 40.

Connecting rod portion 26 is connected to pivotal latch member 35 by a pivot pin 38 and rod portion 29 is pivotally connected to hinge member 21 by a pivot pin 39. Thus, spring 24 concurrently biases latch member 35 in a counterclockwise direction to the hinge pin engaging disposition and latch member 21 in a clockwise direction to the hinge pin engaging disposition when the door is in the closed position of FIG. 3.

When the door is swung open from either side, the outward movement of the door causes the hinge pin to cam the associated pivotally mounted latch member against the biasing action of spring 24 so as to release the hinge pin from the movable latch member recess 23 and, at the same time, permit the interlock element 30 to be pivoted under the biasing action of spring 33 to engage the notch 41 thereof with the interlock element 32 on the pivotal hinge member so as to interlock the movable hinge member in the open position, as illustrated in FIG. 4.

At the same time, the pivotal movement of the movable latch member urges its associated rod portion toward the other rod portion against the biasing action of spring 24. Such movement may continue until pin projection 25 substantially bottoms in the recess. Thus, any tendency for the movable latch member of the unopened latch to move away from the closed disposition embracing the associated hinge pin, is effectively prevented by the bottoming of the latch pin in the recess.

Thus, the bottoming of the projection pin 25 cooperates with the interlock means 40,37 in assuring that the door remains hingedly connected to the cabinet at one side of the opening when the door is opened from either side, while at the same time, maintaining the opened latch in the open disposition for facilitated relatching thereof when the door is brought back to the closed disposition.

As the only force necessary to effect the relatching of the mechanism upon closing of the door is the movement of the interlock element 30 from the interlocked disposition wherein the notch 41 thereof receives the interlock pin 32, only a very small force is necessary to effect the latching operation, providing facilitated door closing and latching functioning.

On the other hand, the spring 24 provides a positive retention of the movable latch members in latching disposition when the door is in the closed arrangement, requiring a positive movement of the door therefrom by pulling on the desired handle 15 to effect the door opening operation.

The foregoing disclosure of specific embodiments is illustrative of the broad inventive concepts comprehended by the invention.

Having described the invention, the embodiments of the invention in which an exclusive property or privilege is claimed are defined as follows:

1. In an enclosure structure having a cabinet defining an access opening and a door for selectively closing said opening, said door defining opposite sides, improved mounting means for mounting the door to the cabinet for releasably retaining the door in a closed position across the opening and permitting the door to be swung open outwardly from either of said sides to an open position, said improved mounting means comprising:

a first hinge pin fixed to the cabinet at one side of the opening;

a second hinge pin fixed to the cabinet at the opposite side of the opening;

first latch means on one side of the door releasably embracing said first hinge pin in a closed disposition thereof to define a first pivotal connection of the door to the cabinet;

second latch means on the opposite side of the door releasably embracing said second hinge pin in a closed disposition thereof to define a second, opposite pivotal connection of the door to the cabinet, each of said latch means including an inboard latch member movably mounted to the door for selective disposition in a closed disposition whereby said latch means is in said closed disposition thereof, and an open disposition;

a resiliently extensible and contractible connecting rod connected between said movable latch member of said first and second latch means and having a minimum contracted length preselected to prevent movement of either one of said movable latch members from the closed disposition to the open disposition thereof, as by pivotally swinging the door away from the cabinet about one of said hinge pins to cause the other of said hinge pins to be effectively withdrawn from its associated said latch means, the movable latch members having camming surfaces engaged by the hinge pins for urging the movable latch members from the closed disposition thereof to the open disposition thereof as an incident of such withdrawal; and interlock means for maintaining the latch members in the open disposition thereof when urged thereto by the withdrawn hinge pin thereby maintaining said connecting rod in the minimum contracted length disposition as an incident of movement of either of said latch means to the open disposition and releasing the latch member to be urged to said closed disposition as an incident of the hinge pin being effectively returned into engagement with the latch means;

each said interlock means comprises interlocking elements mounted on the latch means for retaining either latch member in the open disposition thereof when the door is swung open to displace the latch member from engagement with its associated said hinge pin, said interlock means comprising a first interlock element movably mounted on the door and a second interlock member on the movable latch member, and means biasing the first interlock member into interlocking engagement with the second interlock member as as incident of movement of the latch means to the open disposition;

said first interlock member comprises a link which is pivotally mounted to said fixed latch member and defines a notch which is spaced from its pivot point, said second interlock member comprises a projection on the movable latch member, and said biasing means comprises a spring for urging the notch portion of said movable link and said projection into interlocked association.

2. The enclosure structure of claim 1 wherein said connecting rod includes a pair of rigid rod portions disposed in end-to-end alignment, resilient means biasing said rod portions apart, and cooperating stop means on said rod portions for limiting contracting movement of the rods toward each other.

3. In an enclosure structure having a cabinet defining an access opening, and a door for selectively closing said opening, said door defining opposite sides, improved mounting means for mounting the door to the cabinet for releasably retaining the door in a closed position across the opening and permitting the door to be swung open outwardly from either of said sides to an open position, said improved mounting means comprising:

a first hinge pin fixed to the cabinet at one side of the opening;

a second hinge pin fixed to the cabinet at the opposite side of the opening;

a first latch means on one side of the door comprising a fixed latch member fixed to the door and a movable latch member pivotally carried by the door and cooperatively releasably embracing said first hinge pin in a closed disposition thereof to define a second pivotal connection of the door to the cabinet;

a second latch means comprising a fixed latch member and a pivotally movable latch member carried by the door and releasably embracing said second hinge pin to define a second pivotal connection of the door to the cabinet, said movable latch members being selectively disposed in said closed disposition thereof, and an open disposition;

means interconnecting said pivotally movable latch members to prevent movement of either one of the movable latch members from the closed disposition thereof when the other latch member is caused to be moved to the open disposition thereof, the movable latch members having camming surfaces engaged by the hinge pins for urging the movable latch members from the closed disposition thereof to the open disposition thereof as an incident of the associated said hinge pin being withdrawn from the latch means thereof; and cooperating interlock means on the latch members for releasably retaining either movable latch member in the open disposition thereof as long as its associated said hinge pin is withdrawn, thereby maintaining said interconnecting means arranged to prevent movement of the other latch member from said closed disposition, said interlock means of each said latch means comprises a first interlock element movably mounted to one of the fixed and movable latch members thereof, a second interlock element carried by the other latch member thereof, and biasing means for urging the interlock elements into interlocked association comprising spring means connected between the movable latch member and the movable interlock element, said first interlock element comprises a link which is pivotally mounted to said fixed latch member and defines a notch which is spaced from its pivot point, said second interlock element comprises a projection on the movable latch member, and said biasing means comprises a spring for urging the notched portion of said movable link and said projection into interlocked association.

* * * * *